US009895572B2

(12) United States Patent
Donato et al.

(10) Patent No.: US 9,895,572 B2
(45) Date of Patent: Feb. 20, 2018

(54) EXERCISING APPARATUS

(71) Applicant: Strength Training Innovations, LLC, Punta Gorda, FL (US)

(72) Inventors: Stephen M Donato, Ft Myers, FL (US); Joseph M Hazard, III, Port Charlotte, FL (US)

(73) Assignee: STRENGTH TRAINING INNOVATIONS, LLC, Punta Gorda, FL (US)

( * ) Notice: Subject to any disclaimer, the term of this patent is extended or adjusted under 35 U.S.C. 154(b) by 124 days.

(21) Appl. No.: 14/885,411

(22) Filed: Oct. 16, 2015

(65) Prior Publication Data

US 2016/0107020 A1 Apr. 21, 2016

Related U.S. Application Data

(60) Provisional application No. 62/064,739, filed on Oct. 16, 2014.

(51) Int. Cl.
*A63B 21/078* (2006.01)
*A63B 71/00* (2006.01)
*A63B 21/072* (2006.01)

(52) U.S. Cl.
CPC ..... *A63B 21/078* (2013.01); *A63B 21/0726* (2013.01); *A63B 71/0036* (2013.01); *A63B 71/0054* (2013.01); *A63B 21/0724* (2013.01); *A63B 2225/09* (2013.01)

(58) Field of Classification Search
CPC ... A63B 21/06; A63B 21/0622; A63B 21/072; A63B 21/0724; A63B 21/0726; A63B 21/078; A63B 21/0783; A63B 21/08; A63B 23/1218; A63B 23/1227; A63B 71/0036; A63B 71/0054; A63B 71/023; A63B 2071/026; A63B 2225/09
See application file for complete search history.

(56) References Cited

U.S. PATENT DOCUMENTS 4,615,524 A * 10/1986 Sutherland ..... A63B 21/078 254/2 B
4,666,150 A * 5/1987 Segrist ..... A63B 21/078 211/85.7
4,711,449 A * 12/1987 Ochab ..... A63B 21/078 188/166
4,750,739 A * 6/1988 Lange ..... A63B 21/0083 482/104
4,836,535 A * 6/1989 Pearson ..... A63B 21/06 482/101

(Continued)

*Primary Examiner* — Joshua Lee

(57) ABSTRACT

An apparatus for supporting an exercise weight is disclosed. The apparatus includes a frame comprising a base member structurally configured to be placed on a surface, a weight support member coupled to the base member, and at least one movable member movably coupled to the weight support member. The apparatus further includes at least one arm, wherein a first end of the at least one arm is coupled to the movable member. Further, the apparatus includes at least one cradle coupled to a second end of the at least one arm, wherein the at least one cradle is structurally configured to support an exercise weight. Moreover, the apparatus includes an actuator coupled to the movable member, wherein the actuator is configured to change a position of the movable member along the axis.

17 Claims, 9 Drawing Sheets

(56) References Cited

U.S. PATENT DOCUMENTS 4,861,025 A * 8/1989 Rockwell ..... A63B 21/0616 108/167
4,974,839 A * 12/1990 Cantor ..... A63B 21/078 482/104
5,372,556 A * 12/1994 Ropp ..... A63B 21/0615 482/133
5,433,687 A * 7/1995 Hinzman ..... A63B 21/00047 248/580
5,472,397 A * 12/1995 Ammoscato ..... A63B 21/4029 482/104
D385,000 S * 10/1997 Reeder ..... D21/691
5,725,460 A * 3/1998 Marsh ..... A63B 21/078 482/104
5,924,964 A * 7/1999 Hayden ..... A63B 21/078 482/104
5,954,619 A * 9/1999 Petrone ..... A63B 21/078 482/104
5,971,898 A * 10/1999 Schoolfield ..... A63B 21/4029 482/104
D425,152 S * 5/2000 Ceppo ..... D21/662
6,149,556 A * 11/2000 Jordan ..... A63B 21/078 482/104
D441,813 S * 5/2001 Ceppo ..... 482/104
6,623,409 B1 * 9/2003 Abelbeck ..... A63B 21/078 482/101
D495,383 S * 8/2004 Ceppo ..... D21/686
6,811,521 B1 * 11/2004 Musso ..... A63B 21/0626 482/104
D504,164 S * 4/2005 Ceppo ..... D21/686
6,896,644 B1 * 5/2005 Voigt ..... A63B 21/078 248/300
6,926,649 B2 * 8/2005 Slawinski ..... A63B 21/00181 482/104
7,278,959 B2 * 10/2007 Brown ..... A63B 21/0783 482/104
7,285,077 B1 * 10/2007 Marx ..... A63B 21/06 482/104
7,455,629 B2 * 11/2008 Abelbeck ..... A63B 21/078 482/101
7,534,198 B1 * 5/2009 Strong ..... A63B 21/078 482/108
7,963,886 B1 * 6/2011 Schwinn ..... A63B 21/078 482/5
8,057,368 B1 * 11/2011 Lyszczarz ..... A63B 21/156 482/103
8,147,389 B1 * 4/2012 Hoole ..... A63B 23/1227 482/100
9,492,701 B1 * 11/2016 Bognatz ..... A63B 21/072
2004/0248713 A1 * 12/2004 Campanaro ..... A63B 21/068 482/123
2005/0009671 A1 * 1/2005 Hummer, Jr. ..... A63B 21/078 482/94
2006/0135324 A1 * 6/2006 Rullestad ..... A63B 21/00181 482/93
2007/0049472 A1 * 3/2007 Hummer, Jr. ..... A63B 71/0036 482/104
2007/0099773 A1 * 5/2007 Hummer, Jr. ..... A63B 21/078 482/104
2008/0070759 A1 * 3/2008 Chaulk ..... A63B 21/078 482/104
2009/0105052 A1 * 4/2009 Dalebout ..... A63B 21/06 482/133
2009/0124469 A1 * 5/2009 Webber ..... A63B 21/0618 482/98
2009/0286658 A1 * 11/2009 James ..... A63B 21/078 482/104
2012/0157271 A1 * 6/2012 Bauer ..... A63B 71/0036 482/104
2013/0296143 A1 * 11/2013 Staten ..... A63B 21/0618 482/98
2014/0084117 A1 * 3/2014 Klonoski ..... A63B 21/078 248/123.11
2015/0083681 A1 * 3/2015 Childs ..... A63B 21/078 211/85.7
2015/0306443 A1 * 10/2015 Bruni, Jr. ..... A63B 21/078 482/104

* cited by examiner

EXERCISING APPARATUS

This application claims benefit of U.S. Provisional Patent Application No. 62/064,739 filed Oct. 16, 2014.

FIELD OF THE INVENTION

The present invention relates an exercising apparatus. In particular, the present invention relates to an apparatus that provides a functional working platform for exercising with dumbbells.

BACKGROUND

In fitness centers, machines, lifting racks, free weights, and other devices are used in order to help individuals reach their fitness goals. Whether one is a beginner, college athlete, or a professional bodybuilder, it is imperative to workout with proper form and technique in order to maximize results as well as prevent both injuries and unwanted damage to equipment.

Many common weight-training regiments incorporate working muscle groups of the upper and lower body on different days. When working upper body muscle groups, individuals tend to focus on one or more muscle regions per day that include but are not limited the chest, back, shoulders, biceps, and triceps. When training these muscle groups, the use of free weights are quite popular, especially for pressing exercises. Pressing exercises generally incorporate either an Olympic barbell rack setup or dumbbells used with a small, adjustable, and mobile workout bench. The main difference between the two is that a rack setup comprises support components that position the weights above the ground into a safe starting and ending position for the user, while small, adjustable, and mobile workout benches do not. Therefore, the users performing dumbbell press movements (as well as other exercises) on small, adjustable, and mobile workout benches must expel additional energy lifting the weights into a proper starting position. When exercising alone with dumbbells, as the dumbbells increase in weight, it becomes correspondingly more dangerous and difficult to get them into the proper position to begin various movements. After completing a dumbbell exercise, users risk injury when lowering dumbbells onto their body or dropping them on the ground. Dropping dumbbells creates disruptive noise and may cause damage to both equipment and facilities.

Therefore, there is a need for an apparatus to position dumbbells for strength training.

SUMMARY

An apparatus for supporting an exercise weight is disclosed according to some embodiments. The apparatus includes a frame comprising a base member structurally configured to be placed on a surface, a weight support member coupled to the base member, and at least one movable member movably coupled to the weight support member, wherein the movable member is configured to be moved along an axis parallel to the longer axis of the weight support member. The apparatus further includes at least one arm, wherein a first end of the at least one arm is coupled to the movable member. Further, the apparatus includes at least one cradle coupled to a second end of the at least one arm, wherein the at least one cradle is structurally configured to support an exercise weight. Moreover, the apparatus includes an actuator coupled to the movable member, wherein the actuator is configured to change a position of the movable member along the axis.

According to some aspects, an apparatus to position dumbbells for strength training is disclosed. The apparatus allows users to place dumbbells into cradles and position them vertically to accommodate different exercises and user preferences. The cradles are mechanically adjustable. Once the user has completed an exercise, the user can replace the dumbbells in the cradle. This minimizes the risk for injury as well as the problems associated with dropping dumbbells.

DESCRIPTION

The following detailed description is provided with reference to the figures. Exemplary, and in some case preferred, embodiments are described to illustrate the disclosure, not to limit its scope, which is defined by the claims. Those of ordinary skill in the art will recognize a number of equivalent variations in the description that follows. The present disclosure is primarily related to fitness training environments, but it may be applied to other settings and situations.

The present disclosure relates to an apparatus for supporting an exercise weight. The apparatus includes a frame comprising a base member structurally configured to be placed on a surface, a weight support member coupled to the base member, and at least one movable member movably coupled to the weight support member, wherein the movable member is configured to be moved along an axis parallel to the longer axis of the weight support member. The apparatus further includes at least one arm, wherein a first end of the at least one arm is coupled to the movable member. Further, the apparatus includes at least one cradle coupled to a second end of the at least one arm, wherein the at least one cradle is structurally configured to support an exercise weight. Moreover, the apparatus includes an actuator coupled to the movable member, wherein the actuator is configured to change a position of the movable member along the axis.

Figure 1:
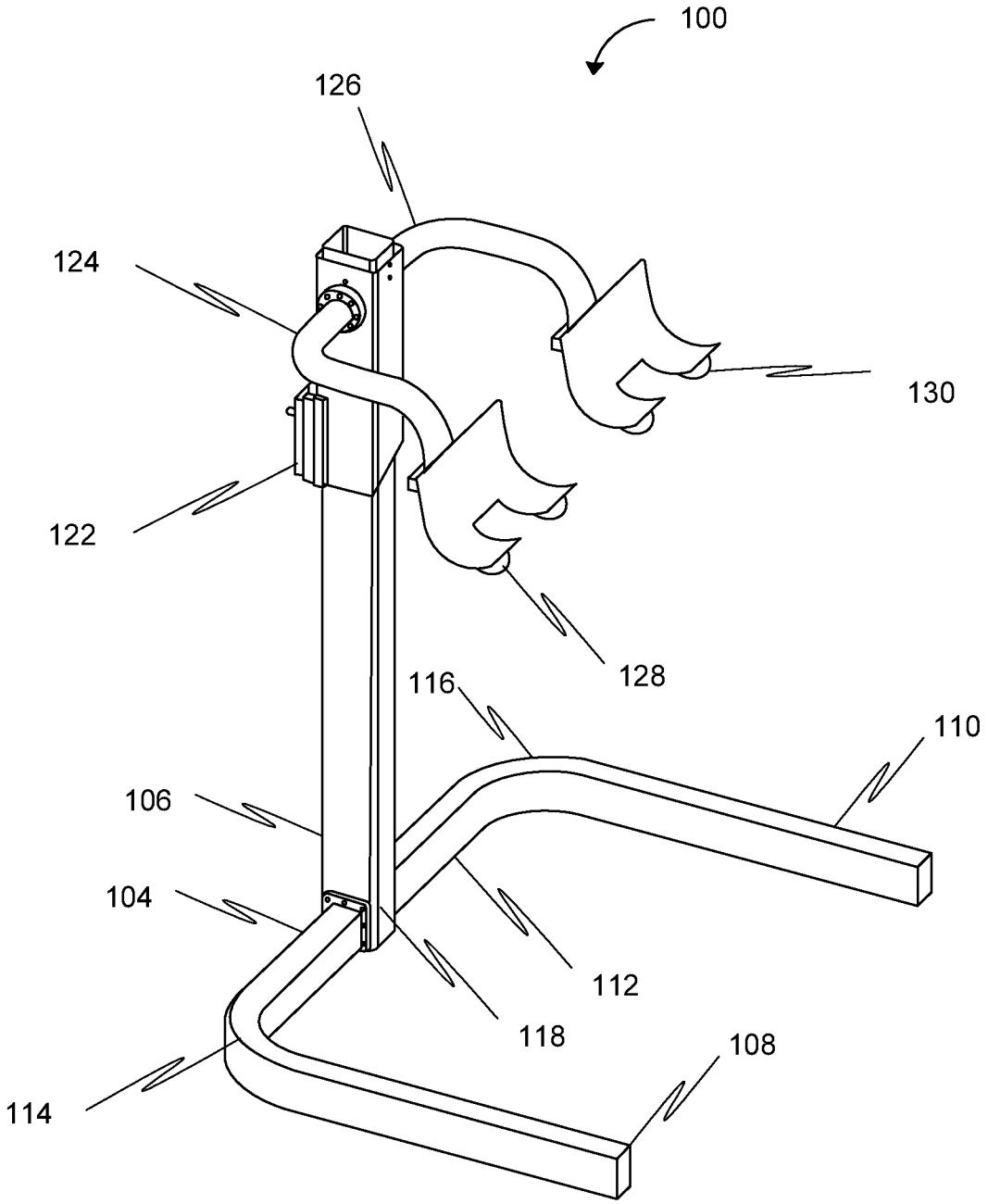
FIG. 1 is a perspective-view of an exercising apparatus, in accordance with an embodiment.

FIGS. 1-4 illustrate an exercising apparatus according to a first exemplary embodiment. FIGS. 5-8 illustrate an exercising apparatus according to a second exemplary embodiment. Referring to FIG. 1, an exercise apparatus 100 for supporting an exercise weight is illustrated in accordance with the first exemplary embodiment. The exercise apparatus 100 comprises a frame including a base member 104 structurally configured to be placed on a surface. The frame is configured to stand freely on the surface. Further, the exercise apparatus 100 includes a weight support member 106 coupled to the base member 104. The weight support member 106 may be attached to the base member 104 in any suitable orientation. For example, the weight support member 106 may be attached to the base member 104 such that the weight support member 106 is vertical in relation to the surface.

The base member 104 may include a first beam 108, a second beam 110 and a third beam 112, wherein the first beam 108 is parallel to the second beam 110. The length of the first beam 108 is equal to a length of the second beam 110. Further, the first beam 108 and the second beam 110 are spatially aligned to form parallel edges of a rectangle. A first end 114 of the third beam 112 is coupled to the first beam 108, and a second end 116 of the third beam 112 is coupled to the second beam 110, wherein the third beam 112 is perpendicular to each of the first beam 108 and the second beam 110. The weight support member 106 is coupled to the third beam 112 at a first end 118 of the weight support member 106. The first beam 108, the second beam 110 and the third beam 112 may comprise metal tubes with a rectangular or a square cross-section.

The exercise apparatus 100 further includes a movable member 122, wherein the movable member 122 is movably coupled to the weight support member 106. The movable member 122 is configured to be moved along an axis parallel to the longer axis of the weight support member 106. The movable member 122 may at least partially embrace a portion of the weight support member 106.

Figure 2:
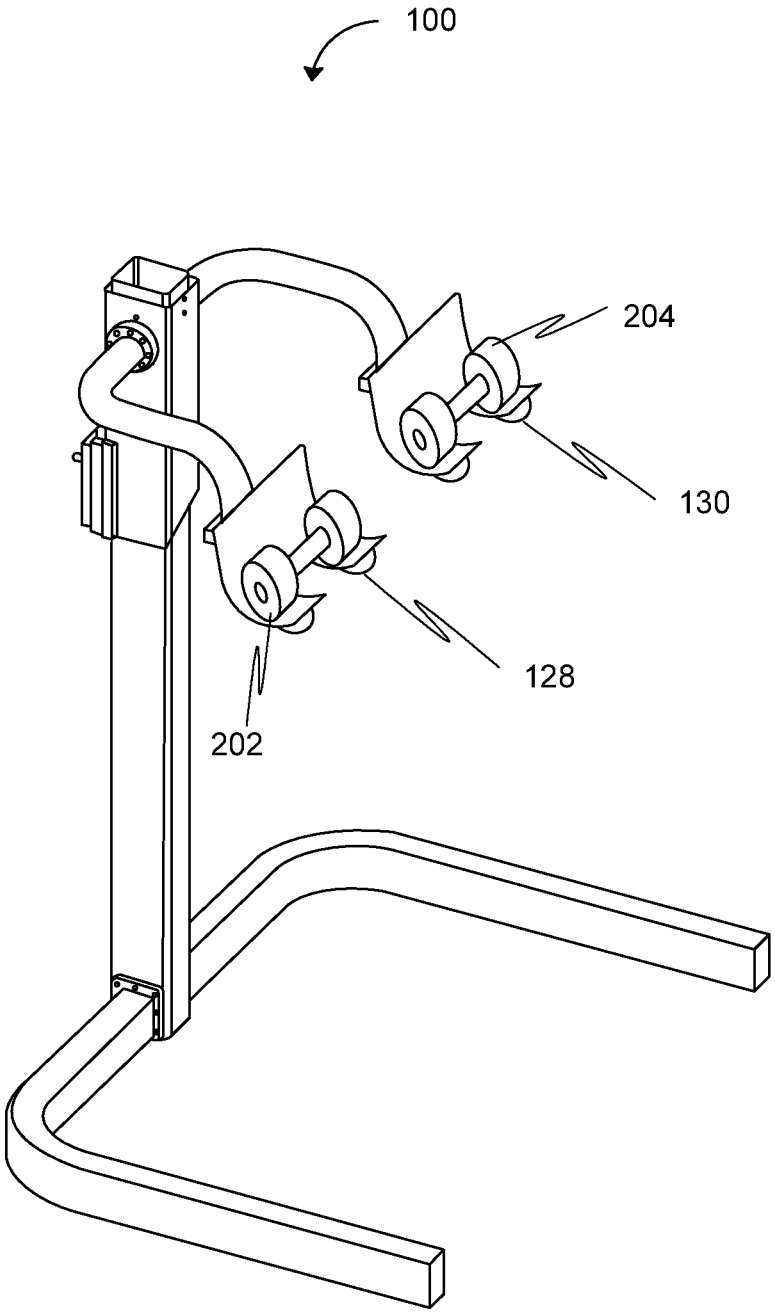
FIG. 2 is a perspective-view of the exercising apparatus of FIG. 1.

The exercise apparatus 100 further includes two arms 124-126, wherein the first ends of each of the two arms 124-126 are coupled to the movable member 122. The second ends of each of two arms 124-126 are coupled to two cradles 128-130 respectively. Therefore, the two cradles 128-130 are coupled to the movable member 122 via the two arms 124-126 respectively. The two cradles 128-130 are structurally configured to support an exercise weight. For example, the exercise weight may be a dumbbell or a barbell. FIG. 2 illustrates two dumbbells 202-204 placed on the two cradles 128-130. For example, the two cradles 128-130 may be used to support and hold dumbbells of various weights up to 200 lbs.

In an instance of the embodiment, each of the arms 124 and 126 includes a one single piece. In another instance of the embodiment, the arm 124 may include multiple pieces including a first portion beginning from a first end of the one arm 124, a second portion beginning from the second end of the arm 124 and an elbow portion interspersed between the first portion and the second portion. This essentially gives a U-shaped structure to the arm 124. The first portion, the second portion and the elbow may be coupled using any known means. A similar structure may be used for the arm 126. The arm 124 and the arm 126 both have the same size, shape, and material.

Figure 3:
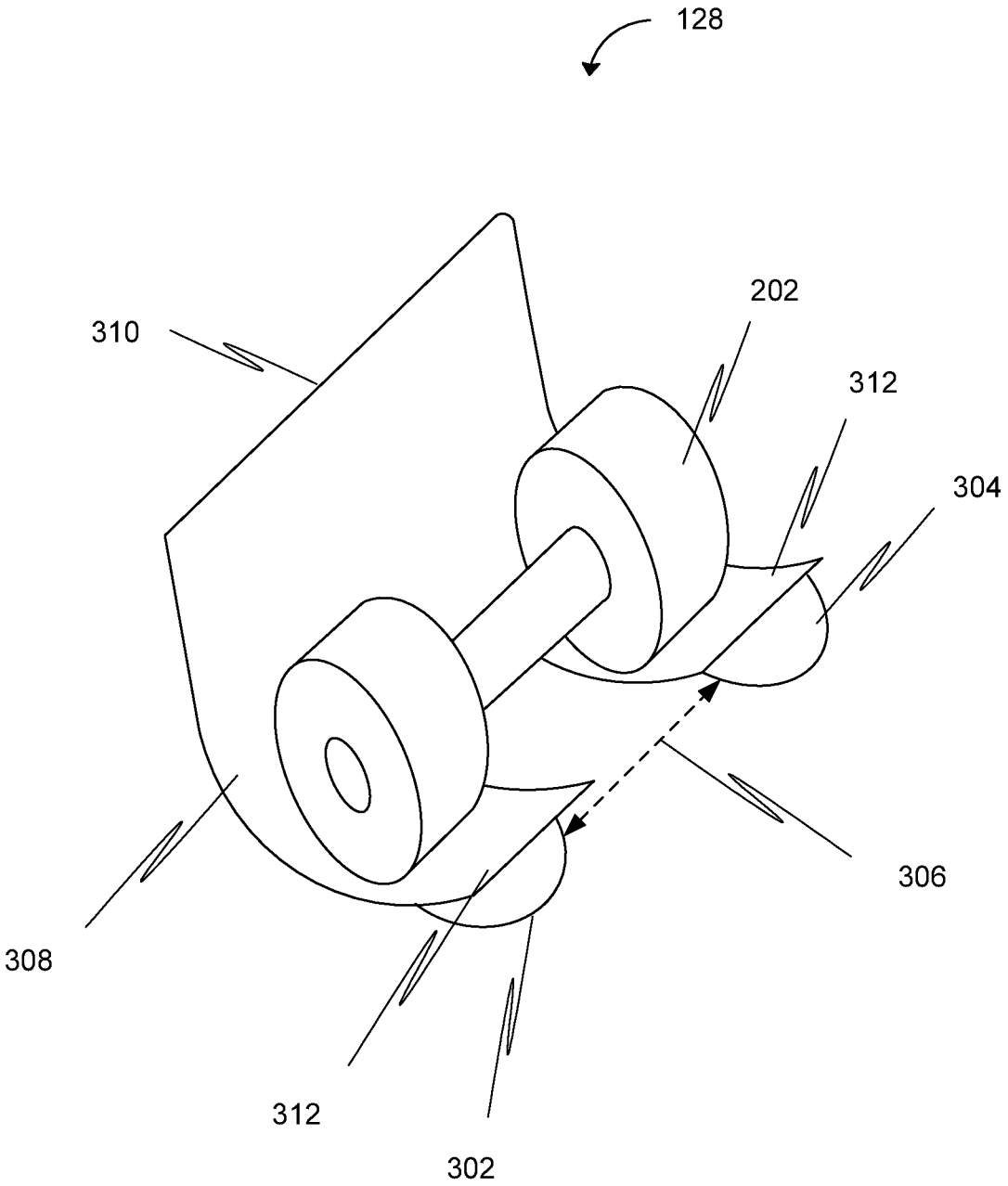
FIG. 3 is a perspective-view of a cradle of the exercising apparatus of FIG. 1.

Each of the cradles 128-130 includes a pair of receiving portions respectively. The receiving portions are structurally configured to receive a portion of the exercise weight. As shown in FIG. 3, the cradle 128 includes a first receiving portion 302 and a second receiving portion 304. Further, the first receiving portion 302 is separated from the second receiving portion 304 by a gap 306 that allows a user's hand to grasp a holding portion of the exercise weight placed in the cradle 128. Each receiving portion of the pair of receiving portions may include a saddle portion. Further, each receiving portion of the pair of receiving portions includes a groove. The cradle 128 and the cradle 130 both have the same size, shape, and material.

The cradles 128-130 further include a backing member. For example, the cradle 128 includes a backing member 308. A first side 310 of the backing member 308 is coupled to the second end of the arm 124 and a second side 312 of the backing member 308 is coupled to each of the first receiving portion 302 and the second receiving portion 304 at a lower portion of the second side.

In an instance of the embodiment, the cradles 128-130 are adjustable, such that they are able to translate, rotate, and swivel about their connections with the arms 124-126 respectively. These connections may include pullout pin locking mechanism. This flexibility allows a user to grip the exercise weights differently. For example, users generally hold dumbbells at differently when performing flies as opposed to press exercises.

Further, the cradles 128-130 may go back to a default position once the user is done with the exercise set.

The exercise apparatus 100 further includes an actuator (not shown) coupled to the movable member 122. The actuator is configured to change a position of the movable member 122 along the axis parallel to the longer axis of the weight support member 106. The actuator may be one of a pneumatic actuator, a hydraulic actuator, an electromechanical actuator and a fuel-powered actuator. The hydraulic actuator further being a manual rotary hydraulic pump in the preferred embodiment. Further, the movable member 122 is configured to remain at a position along the axis independent of each of presence of the exercise weight in the cradles 128-130 and an operational state of the actuator. In this case, the actuator is required only to change the height of a cradle from ground, whereas no energy is expended in maintaining the cradle at a desired height.

In an instance of the embodiment, the weight support member 106 may include a locking mechanism, such that the movable member 122 smoothly translates vertically up or down along the weight support member 106 when the locking mechanism is disengaged or released. For example, by releasing the locking mechanism, the user may move the movable member 122 to the appropriate height off the ground. The locking mechanism may be either a pullout pin or a rotatable crank.

In case the locking mechanism is a pullout pin, the user simply pulls a spring-loaded handle extending orthogonally from both the weight support member 106 and the movable member 122. The spring-loaded handle is attached to a cylindrical shaft that penetrates one of a plurality of equidistant holes placed vertically up the entire length of the weight support member 106. The spring-loaded handle is screwed into a housing that extends orthogonally out of the movable member 122. Each of the plurality of holes is dimensioned to snuggly fit within the aforementioned cylindrical shaft concentrically. When the user pulls the spring-loaded handle, the cylindrical shaft retracts from one of the plurality of equidistant holes. With the spring-loaded handle in the retracted position, the user can smoothly use a vertical force upwards or downwards to translate the movable member 122 to the appropriate location. When the movable member 122 is in place, the user simply releases the spring-loaded handle, causing the cylindrical shaft to penetrate one of the selected plurality of equidistant holes. The locking mechanism works with the spring to prevent the pullout pin or handle from moving out of place.

However, in case the locking mechanism is a rotatable crank, the rotatable crank would work in conjunction with a system of beveled gears. The rotatable crank may further comprise a handle, extending orthogonally from the edge of the crank, away from the rear of the weight support member 106. By rotating the handle, the beveled gears work in unison transforming rotational motion into translational motion. The final beveled gear comprises a threaded cylindrical hole. The gear is concentrically attached to a threaded shaft housed within the main beam. By turning the handle, the rotatable crank's movement actuates the system of beveled gears. The final threaded gear then moves up or down the threaded shaft based on the direction of rotation. This system of gears and rotatable crank are all connected to the movable member 122, which move simultaneously based on the movement of the final threaded gear. A pin may be inserted into the movable member 122, the weight support member 106, and rotatable crank as a locking mechanism to prevent unwanted movement of the movable member 122.

Figure 4:
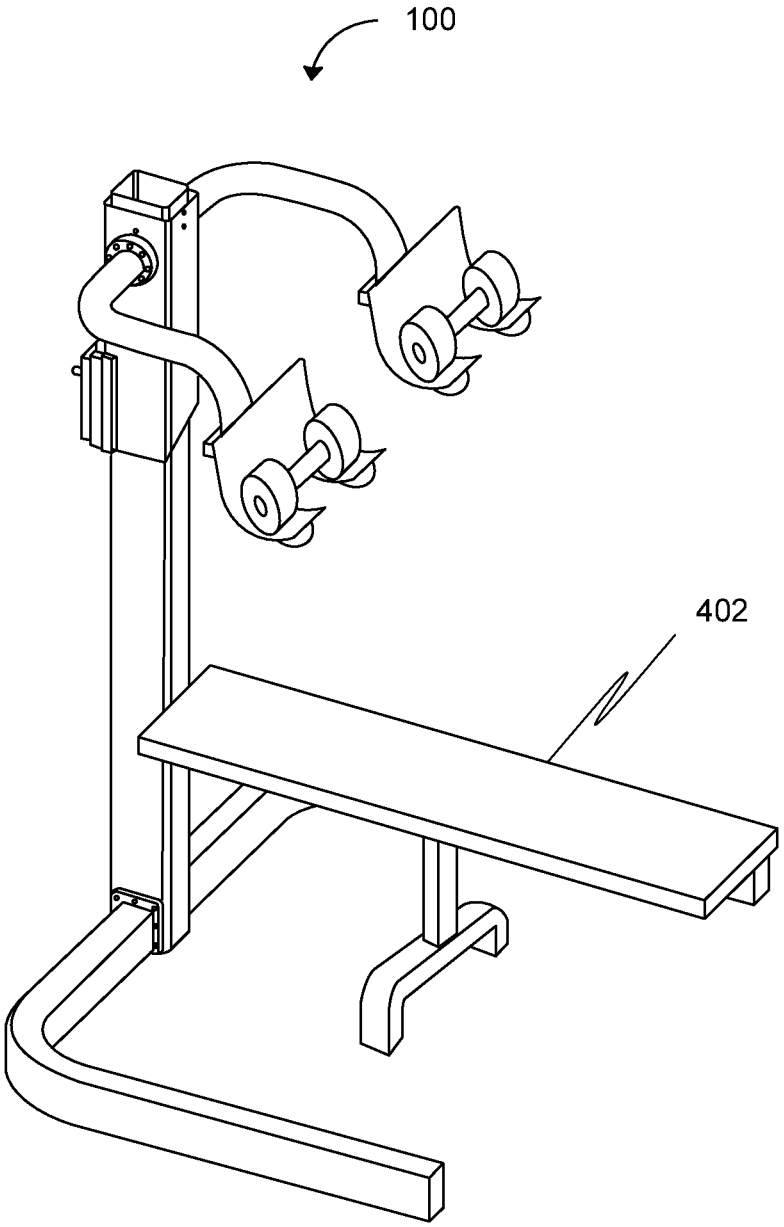
FIG. 4 is a perspective-view of the exercising apparatus of FIG. 1.

Yet further, the exercise apparatus 100 includes a user support member 402 configured to support weight of a user as shown in FIG. 4. A user may sit or lie down on the user support member 402. The user adjusts the movable member 122 such that the position of the exercise weight placed in the cradles 128-130 is at arm's length from the user. The user support member 402 may be used for exercises that include but are not limited to seated military press (shoulder press), bench press, inclined bench, pectoral flies, incline flies, and more. If the user wishes to perform standing exercises such as standing military press, the user may simply move the user support member 402 out of the way.

Further, the user support member 402 comprises two adjustable two padded sections (not shown). One of the padded sections is longer than the second one. The short section functions as a seat bottom and the long section functions as a seat back. The long and the short sections may change angles in conjunction with the translation of the movable member 122. For example, when a user raises the movable member 122 upwards, the angle between the long and short section of the bench will decrease, allowing users the ability to perform exercises at an inclined angle. When a user lowers the movable member 122 downwards, the angle between the long and short section of the bench will increase.

Figure 5:
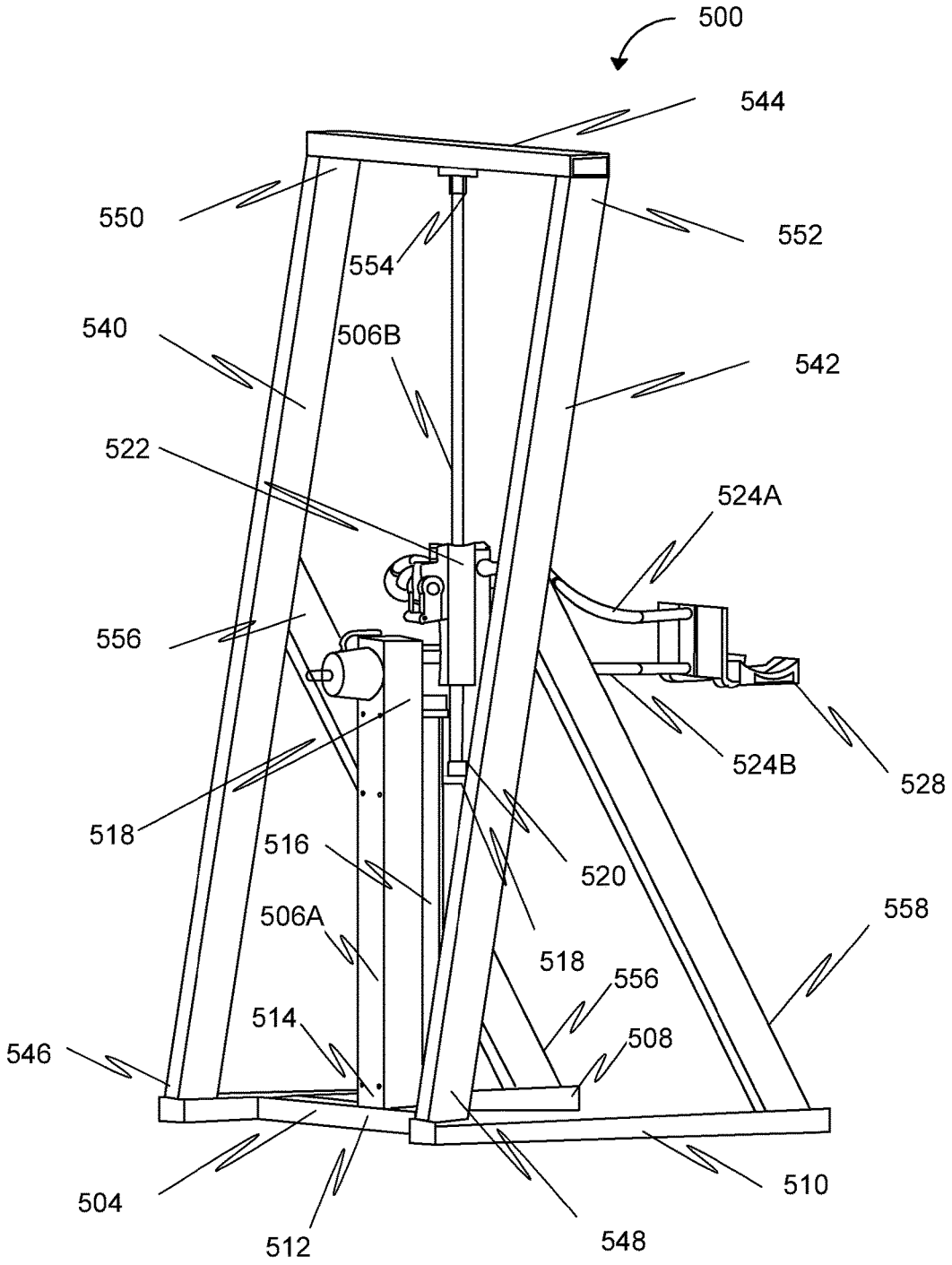
FIG. 5 is a perspective-view of an exercising apparatus, in accordance with an embodiment.
Figure 6:
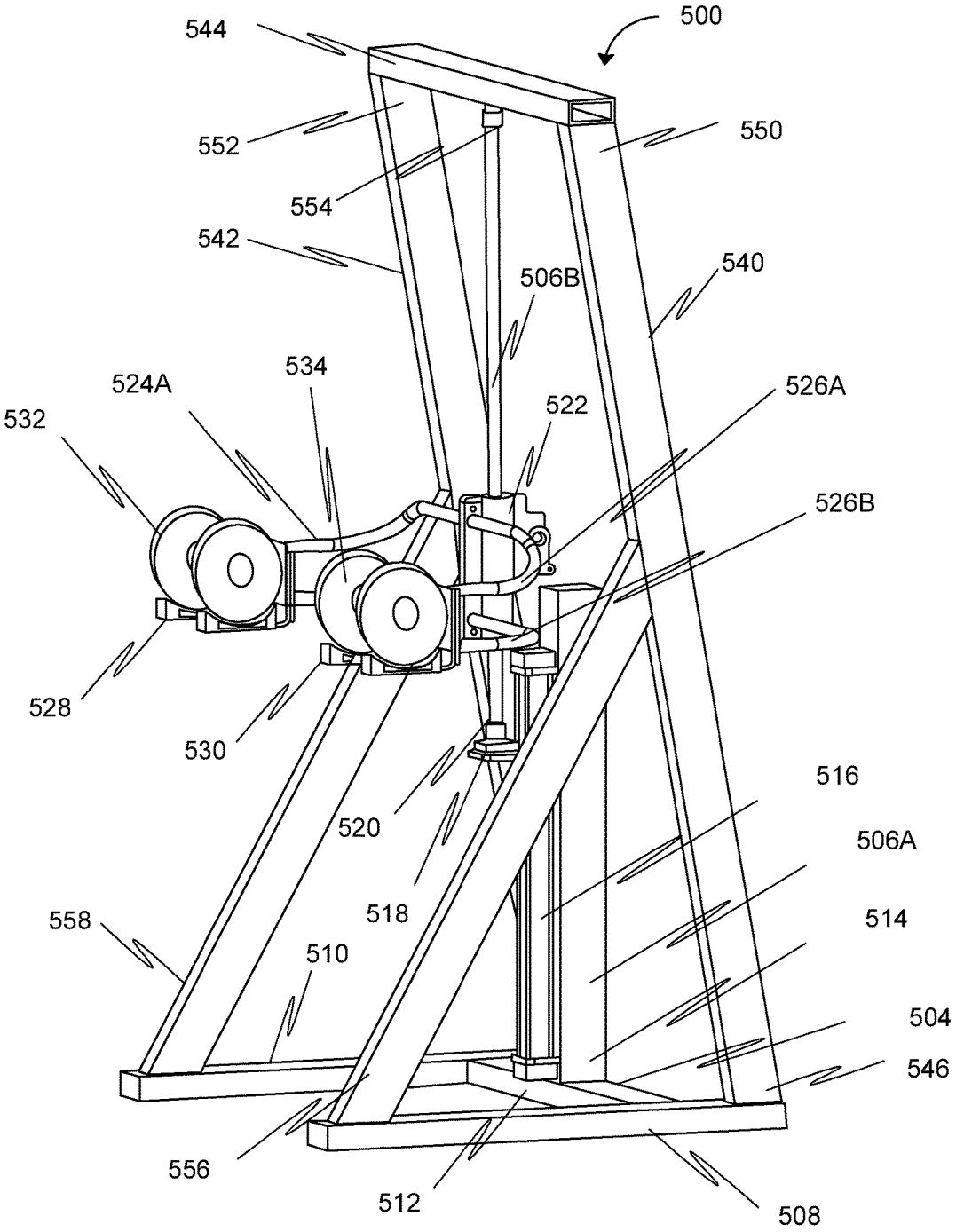
FIG. 6 is a perspective-view of the exercising apparatus of FIG. 5.
Figure 7:
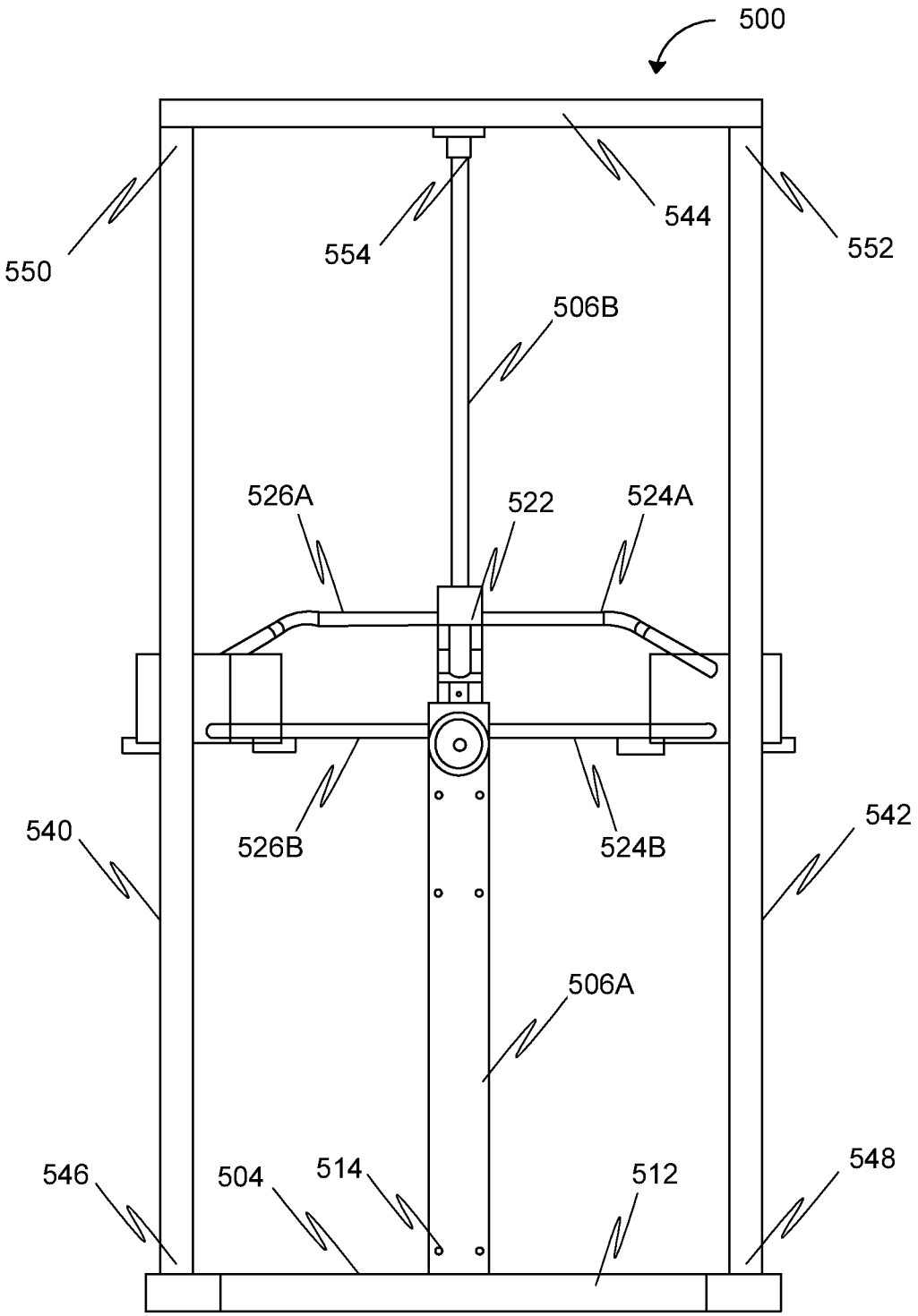
FIG. 7 is a rear-view of the exercising apparatus of FIG. 5.
Figure 8:
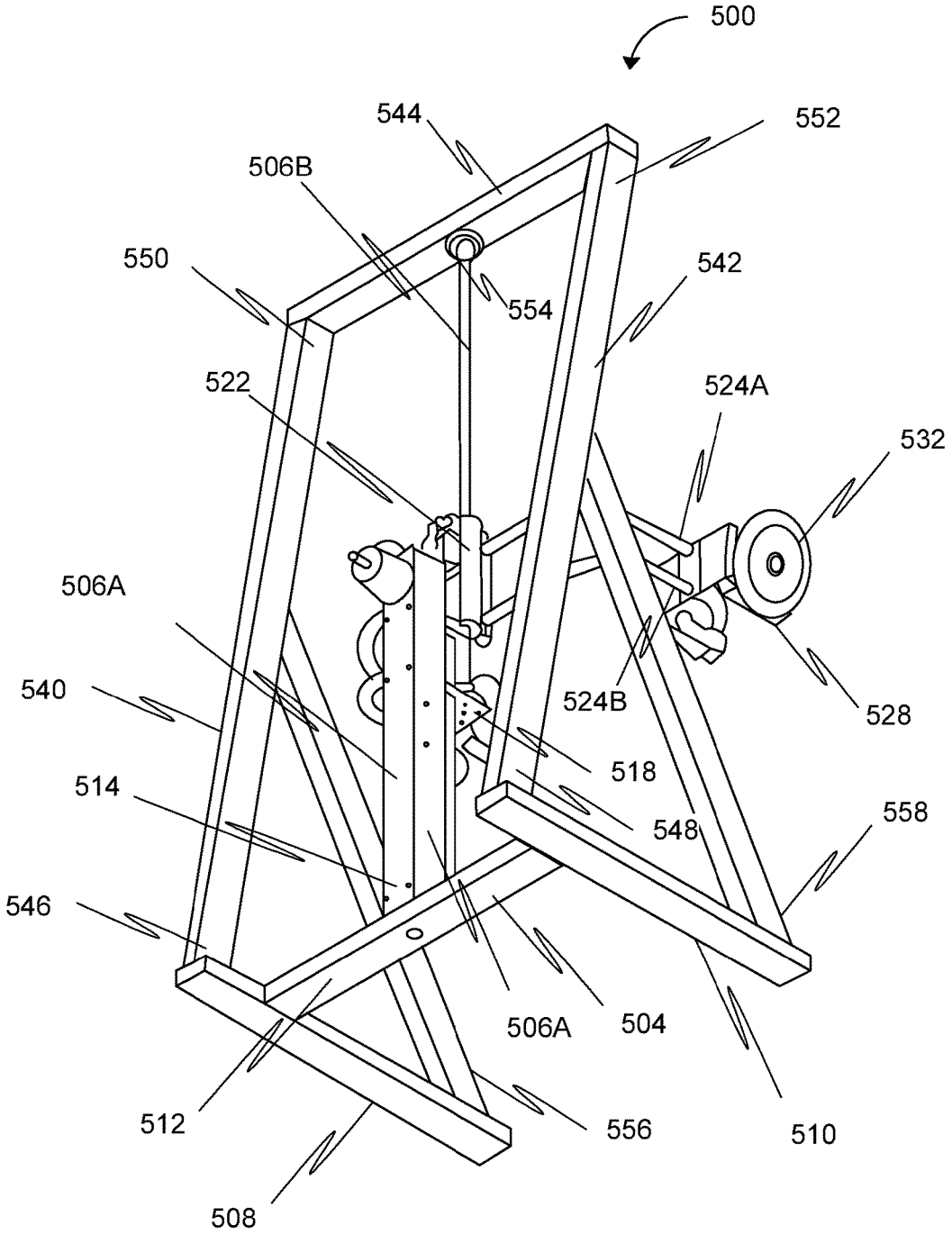
FIG. 8 is a perspective-view of the exercising apparatus of FIG. 5.
Figure 9:
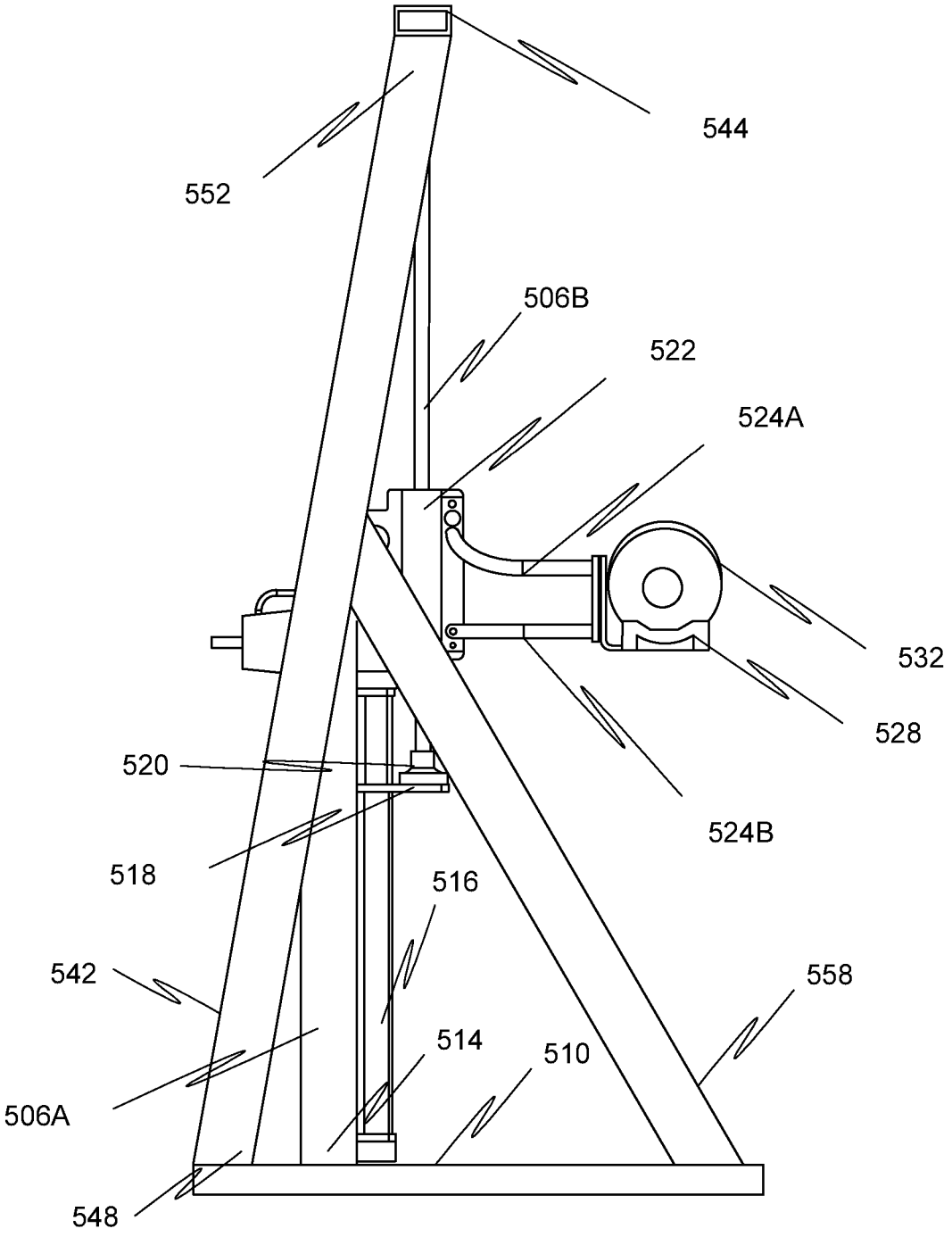
FIG. 9 is a side-view of the exercising apparatus of FIG. 5.

Now, referring to FIGS. 5-9, an exercise apparatus 500 for supporting an exercise weight is illustrated in accordance with the second exemplary embodiment. FIG. 5 illustrates a first perspective view of the exercise apparatus 500, FIG. 6 illustrates a second perspective view of the exercise apparatus 500, FIG. 7 illustrates a rear view of the exercise apparatus 500, FIG. 8 illustrates a third perspective view of the exercise apparatus 500, and FIG. 9 illustrates a side view of the exercise apparatus 500.

The exercise apparatus 500 comprises a frame including a base member 504 structurally configured to be placed on a surface. The frame is configured to stand freely on the surface. The base member 504 may include a first beam 508, a second beam 510 and a third beam 512, wherein the first beam 508 is parallel to the second beam 510. The length of the first beam 508 is equal to a length of the second beam 510. Further, the first beam 508 and the second beam 510 are spatially aligned to form parallel edges of a rectangle. A first end of the third beam 512 is coupled to the first beam 508 and a second end of the third beam 512 is coupled to the second beam 110, wherein the third beam 512 is perpendicular to each of the first beam 508 and the second beam 510.

Further, the exercise apparatus 500 includes a weight support member, which comprises two sections, a first section 506A and a second section 506B. The first section 506A and the second section 506B may be a metal tube with a rectangular, square, or a circular cross-section. A first end 514 of the first section 506A is coupled to the base member 504. Specifically, the first end 514 of the first section 506A is coupled to the third beam 512. The first section 506A may be attached to the base member 504 in any suitable orientation. For example, the first section 506A may be attached to the base member 504 such that the weight support member is vertical in relation to the surface. An additional support member 516 may be coupled to the first section 506A. The length of the additional support member 516 is shorter than the length of the first section 506A. Further, the additional support member 516 is coupled in parallel and in close proximity to the first section 506A.

A plate member 518, coupled to at least one of the first section 506A and the additional support member 516, extends in a perpendicular direction to the first section 506A and the additional support member 516. The plate member 518 provides a platform for a first end 520 of the second section 506B. The second section 506B is coupled to the plate member 518. The second section 506B extends vertically upwards and away from the plate member 518.

The exercise apparatus 500 further includes a movable member 522, wherein the movable member 522 is movably coupled to the second section 506B. The movable member 522 is configured to be moved along an axis parallel to the longer axis of the second section 506B. The movable member 522 may at least partially embrace a portion of the second section 506B.

The exercise apparatus 500 further includes two arms 524-526, wherein the first ends of each of the two arms 524-526 are coupled to the movable member 522. The second ends of each of two arms 524-526 are coupled to two cradles 528-530 respectively. Therefore, the two cradles 528-530 are coupled to the movable member 522 via the two arms 524-526 respectively. Each of the two arms 524-526 includes at least one member. For example, in the second exemplary embodiment, each of the two arms 524-526 includes two members. The arm 524 includes two members 524A and 524B. Similarly, the arm 526 includes two members 526A and 526B. More members may be used to provide more stability and strength to the two cradles 528-530. The cradles 528-530 are structurally configured to support an exercise weight. For example, the exercise weight may be a dumbbell or a barbell. FIGS. 6, 8 and 9 illustrate two dumbbells 532-534 placed on the two cradles 528-530 respectively.

The exercise apparatus 100 further includes an actuator (not shown) coupled to the movable member 522. The actuator is configured to change a position of the movable member 522 along the axis parallel to the longer axis of the weight support member 106. The actuator is at least one a pneumatic actuator, an electromechanical actuator and a fuel-powered actuator. Further, the movable member 522 is configured to remain at a position along the axis independent of each of presence of the exercise weight in the at least one cradle 528-530 and an operational state of the actuator. The actuator is explained in further detail in conjunction with the FIGS. 1-4 above.

The frame of the exercise apparatus further includes at least one weight distribution member coupled to the weight support member at a first end of the at least one weight distribution member, wherein a second end of the at least one weight distribution member is coupled to at least one portion of the base member. Accordingly, the frame of the exercise apparatus 500 includes a weight distribution member, which comprises a structure as described below. The weight distribution member comprises each of a first weight distribution beam 540, a second weight distribution beam 542 and a third weight distribution beam 544. A first end 546 of the first weight distribution beam 540 is coupled to a portion of the first beam 508 of the base member 504, wherein a first end 548 of the second weight distribution beam 542 is coupled to a portion of the second beam 510 of the base member 504. Further, a second end 550 of the first weight distribution beam 540 is coupled to a first end of the third weight distribution beam 544. Similarly, a second end 552 of the second weight distribution beam 542 is coupled to a second end of the third weight distribution beam 544. Moreover, a second end 554 of the second section 506B of the weight support beam is coupled to the third weight distribution beam 544.

The first weight distribution beam 540 may be angled in relation to the first beam 508 of the base member 104. Similarly, the second weight distribution beam 542 may be angled in relation to the second beam 510 of the base member 104. The third weight distribution beam 544 is perpendicular to each of the first weight distribution beam 540 and the second weight distribution beam 542.

The weight distribution member of the exercise apparatus 500 further includes each of a fourth weight distribution beam 556 and a fifth weight distribution beam 558. A first end of the fourth weight distribution beam 556 is coupled to the first weight distribution beam 540, wherein a second end of the fourth weight distribution beam 556 is coupled to the base member 104 (the first beam 508). Similarly, a first end of the fifth weight distribution beam 558 is coupled to the second weight distribution beam 542, wherein a second end of fifth weight distribution beam 558 is coupled to the base member 104 (the second beam 510). Further, each of the fourth weight distribution member 556 and the fifth weight distribution member 558 is angled in relation to the base member 104.

As shown in FIG. 7, the left side of the exercise apparatus 500 is symmetrical to the right side of the exercise apparatus 500. Therefore, the components on the left side are physically and mechanically the same as the components on the right side; however, they are positionally mirror images of each other.

In the embodiments described above, various components may be coupled using one of, but not limited to, a weld, a magnetic, a screw or a bolt connection. Further, the couplings may be rigid or non-rigid couplings.

It will be appreciated that various above-disclosed embodiments, other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

We claim:

1. An apparatus for supporting an exercise weight comprising:

a base member;

the base member being structurally configured to be placed on a surface;

a weight support member;

the base member and the weight support member being coupled to each other;

a movable member;

the movable member being movably coupled to the weight support member;

the movable member being configured to be moved along an axis parallel to a longer axis of the weight support member;

an arm;

the movable member and the arm being coupled to each other;

a cradle;

the arm and the cradle being coupled to each other;

the arm comprising a first end and a second end;

the first end and the second end being opposite to each other;

the first end being coupled to the movable member;

the second end being coupled to the cradle;

the cradle being structurally configured to support an exercise weight;

an actuator;

the actuator being coupled to the movable member;

the actuator being configured to change a position of the movable member along the axis;

the arm comprising a first portion, a second portion and an elbow portion;

the first portion extending from the first end substantially along a first direction;

the second portion extending from the second end substantially along a second direction;

the elbow portion being interspersed in between the first portion and the second portion;

the elbow portion being formed by the first direction and the second direction being substantially perpendicular to each other;

the base member comprising a first base beam, a second base beam and a third base beam;

the first base beam being parallel to the second base beam;

a length of the first base beam being equal to a length of the second base beam;

the first base beam and the second base beam being spatially aligned to form parallel edges of a rectangle;

the third base beam comprising a first extremity and a second extremity;

the first extremity and the second extremity being opposite to each other;

the first extremity being coupled to the first base beam;

the second extremity being coupled to the second base beam;

the third base beam being perpendicular to each of the first base beam and the second base beam;

the weight support member comprising a first terminus;

the first terminus being coupled to the third base beam;

a weight distribution member;

the weight distribution member comprising a first weight distribution beam, a second weight distribution beam and a third weight distribution beam;

the first weight distribution beam, the second weight distribution beam and the third weight distribution beam each comprising a first beam terminal and a second beam terminal;

the first beam terminal of the first weight distribution beam being coupled to a portion of the first base beam;

the first beam terminal of the second weight distribution beam being coupled to a portion of the second base beam;

the second beam terminal of the first weight distribution beam being coupled to the first beam terminal of the third weight distribution beam;

the second beam terminal of the second weight distribution beam being coupled to the second beam terminal of the third weight distribution beam;

the weight support member comprising a second terminus; and the second terminus being coupled to the third weight distribution beam.

2. The apparatus of claim 1 comprising:

the exercise weight being a dumbbell or a barbell.

3. The apparatus of claim 1 comprising:

the apparatus being configured to stand freely on the surface.

4. The apparatus of claim 1 comprising:

the weight support member being vertical in relation to the surface.

5. The apparatus of claim 1 comprising:

the movable member at least partially embracing a portion of the weight support member.

6. The apparatus of claim 1 comprising:

another arm;

the movable member and the another arm being coupled to each other;

another cradle; and the another arm and the another cradle being coupled to each other.

7. The apparatus of claim 1 comprising:

the movable member being configured to remain at a position along the axis independent of a presence of the exercise weight in the cradle and an operational state of the actuator.

8. The apparatus of claim 1 comprising:

the cradle comprising a first receiving portion and a second receiving portion;

the first receiving portion and the second receiving portion being structurally configured to receive a portion of the exercise weight;

the first receiving portion being separated from the second receiving portion by a gap; and the gap being sufficient to enable a hand to grasp a holding portion of the exercise weight placed in the cradle.

9. The apparatus of claim 8 comprising:

the first receiving portion and the second receiving portion each comprising a saddle.

10. The apparatus of claim 8 comprising:

the first receiving portion and the second receiving portion are concave.

11. The apparatus of claim 8 comprising:

the cradle further comprising a backing member;

the backing member comprising a first side and a second side;

the first side and the second side being opposite to each other;

the first side being coupled to the second end; and the second side being coupled to the first receiving portion and the second receiving portion at a lower portion thereof.

12. The apparatus of claim 1 comprising:

a weight distribution member;

the weight distribution member comprising a first terminal and a second terminal;

the first terminal and the second terminal being opposite to each other;

the first terminal being coupled to the weight support member; and the second terminal being coupled to the base member.

13. The apparatus of claim 1 comprising:

the weight distribution member comprising a fourth weight distribution beam and a fifth weight distribution beam;

the fourth weight distribution beam and the fifth weight distribution beam each comprising a first beam terminal and a second beam terminal;

the first beam terminal of the fourth weight distribution beam being coupled to the first weight distribution beam;

the second beam terminal of the fourth weight distribution beam being coupled to the base member;

the first beam terminal of the fifth weight distribution beam being coupled to the second weight distribution beam; and the second beam terminal of the fifth weight distribution beam being coupled to the base member.

14. The apparatus of claim 1 comprising:

the first weight distribution beam being angled in relation to the first base beam;

the second weight distribution beam being angled in relation to the second base beam; and the third weight distribution beam being perpendicular to each of the first weight distribution beam and the second weight distribution beam.

15. The apparatus of claim 13 comprising:

each of the fourth weight distribution beam and the fifth weight distribution beam being angled in relation to the base member.

16. The apparatus of claim 1 comprising:

the actuator being a pneumatic actuator, a hydraulic actuator, an electromechanical actuator or a fuel powered actuator.

17. The apparatus of claim 1 comprising:

a user support member;

the user support member being configured to support weight of a user; and a position of the exercise weight placed in the cradle being at a user-arm's length from the user supported by the user support member.

* * * * *